United States Patent [19]

Feuchter et al.

[11] Patent Number: 4,727,715

[45] Date of Patent: Mar. 1, 1988

[54] METHOD AND APPARATUS FOR STARTING SPINNING OPERATION OF AN OPEN END FRICTION SPINNING AGGREGATE

[75] Inventors: Wolfgang Feuchter, Deggingen-Reichenbach; Wolfram Ilg, Bad Überkingen; Johann Weber, Deggingen, all of Fed. Rep. of Germany

[73] Assignees: Fritz Stahlecker; Hans Stahlecker, both of Fed. Rep. of Germany

[21] Appl. No.: 13,788

[22] Filed: Feb. 12, 1987

[30] Foreign Application Priority Data

Feb. 25, 1986 [DE] Fed. Rep. of Germany ..... 3606015

[51] Int. Cl.[4] ..... D01H 15/00; D01H 7/892

[52] U.S. Cl. ..... 57/263; 57/401; 57/81

[58] Field of Search ..... 57/78, 81, 261, 263, 57/264, 300, 301, 400, 401

[56] References Cited

U.S. PATENT DOCUMENTS

| | | | |
|---|---|---|---|
| 4,571,933 | 2/1986 | Stahlecker | 57/401 |
| 4,592,198 | 6/1986 | Stahlecker | 57/401 |
| 4,598,539 | 7/1986 | Stahlecker et al. | 57/401 X |
| 4,606,186 | 8/1986 | Stahlecker | 57/263 X |
| 4,627,230 | 12/1986 | Stahlecker | 57/401 |

*Primary Examiner*—Donald Watkins

*Attorney, Agent, or Firm*—Barnes & Thornburg

[57] ABSTRACT

A piecing process is provided for an open-end friction spinning apparatus of the type including movable friction surface members forming a yarn-forming zone therebetween. A friction surface driving device for moving the friction surface members during operation and for interrupting the movement of the friction surface members is also included in the apparatus. The spinning apparatus further includes a yarn end orientation member for orienting a yarn end during the piecing process. The process includes placing a yarn end into the yarn-forming zone when the rollers are stopped. The friction surface members are started such that the yarn end is prevented from being pulled too deeply into the yarn-forming zone by the yarn end orientation device. An apparatus for carrying out this process is also provided.

25 Claims, 2 Drawing Figures

METHOD AND APPARATUS FOR STARTING SPINNING OPERATION OF AN OPEN END FRICTION SPINNING AGGREGATE

BACKGROUND AND SUMMARY OF THE INVENTION

The invention relates to a piecing process of an open-end friction spinning unit of the type including friction surface members for forming yarn in a yarn-forming zone. The friction surface members are moved and interrupted by a friction surface driving device.

In a known piecing process of this type (DE-OS No. 33 21 234), the drive of the rollers is interrupted when the yarn end to be pieced is inserted into the yarn-forming zone formed in the wedge-shaped gap. During this time, the suction device is also switched off. During the piecing, the suction device is first switched on again, and then, while the piecing takes place, the drive of the rollers is restarted. However, it was found that during the restarting of the rollers for a piecing process, yarn breakages frequently occur again immediately.

An object of the invention is to provide a process and an arrangement in which the rate of success of the piecing can be increased.

This object is achieved by providing a yarn orientation device which orients the yarn during a piecing process. The piecing process includes placing the yarn end into the yarn-forming zone when the friction surface members are stopped. When the friction surface members are started, the yarn orientation device prevents the yarn end from being pulled too far into the yarn-forming zone.

Further advantageous features of a preferred embodiment include friction rollers operating as the friction surface device, and the rollers are started in such a way that the roller rotating out of the yarn-forming zone starts at the same time as or earlier than the roller rotating into the yarn-forming zone.

In another advantageous feature of a preferred embodiment of the invention, a suction device is provided for holding forming yarn in the yarn-forming zone. In this embodiment, the suction device is switched off when the yarn to be pieced is inserted, and the suction device is switched on after the restarting of the drive of the rollers.

In other advantageous features of a preferred embodiment of the invention, the suction device is also switched off when the yarn end to be pieced is inserted. The drive of the rollers is designed in such a way that the roller rotating out of the yarn-forming zone starts at the same time as or earlier than the roller rotating into the yarn-forming zone, and the suction device is switched on after the restarting of the drive of the rollers.

All these features are based on the recognition that a cause of an unsuccessful piecing is that during the starting of the rollers, the roller rotating into wedge-shaped gap sometimes starts first, and the yarn end to be pieced is pulled too deeply into the wedge-shaped gap, is overtwisted and torn off. This can be avoided according to the advantageous features discussed above, by assuring that during the piecing, the yarn end does not enter too deeply into the wedge-shaped gap. This can be achieved either by assuring that the roller rotating out of the wedge-shaped gap does not start in a delayed way or assuring that the suction pull is not in effect during the piecing. The safest way is a combination of these two measures. In view of the fact that the rollers usually run up to the operating speed in a time period of about one second, it is sufficient that the earlier starting of the roller rotating out of the wedge-shaped gap and/or the delayed switching-on of the suction pull of the suction device takes place in fractions of a second.

In other advantageous features of a preferred embodiment of the invention, for carrying out the process a driving belt is provided that drives the rollers. The driving belt can be lifted off for interrupting the operation and can be placed back for restoring it. The rollers are arranged relative to the driving belt in such a way, and/or the driving belt is guided by guiding elements in such a way that when the driving belt is placed back onto the rollers, the driving belt is first placed on the roller rotating out of the yarn-forming zone. Thus it is reliably achieved that the desired earlier starting of the roller rotating out of the yarn-forming zone takes place.

In other advantageous features of a preferred embodiment of the invention, an arrangement for carrying-out the process is provided that includes a device for the lifting off and placing back of a driving belt driving the rollers which is coupled with a device for the switching-on and switching-off of the suction device in such a way that the switching-back-on of the suction device is delayed with respect to the placing of the driving belt back onto the rollers. In both cases, it is assured by a constructive development that the desired starting conditions occur automatically without special measures taken by an operator or by an automatic servicing arrangement.

Other objects, advantages and novel features of the present invention will become apparent from the following detailed description of the invention when considered in conjunction with the accompanying drawings.

Figure 1:
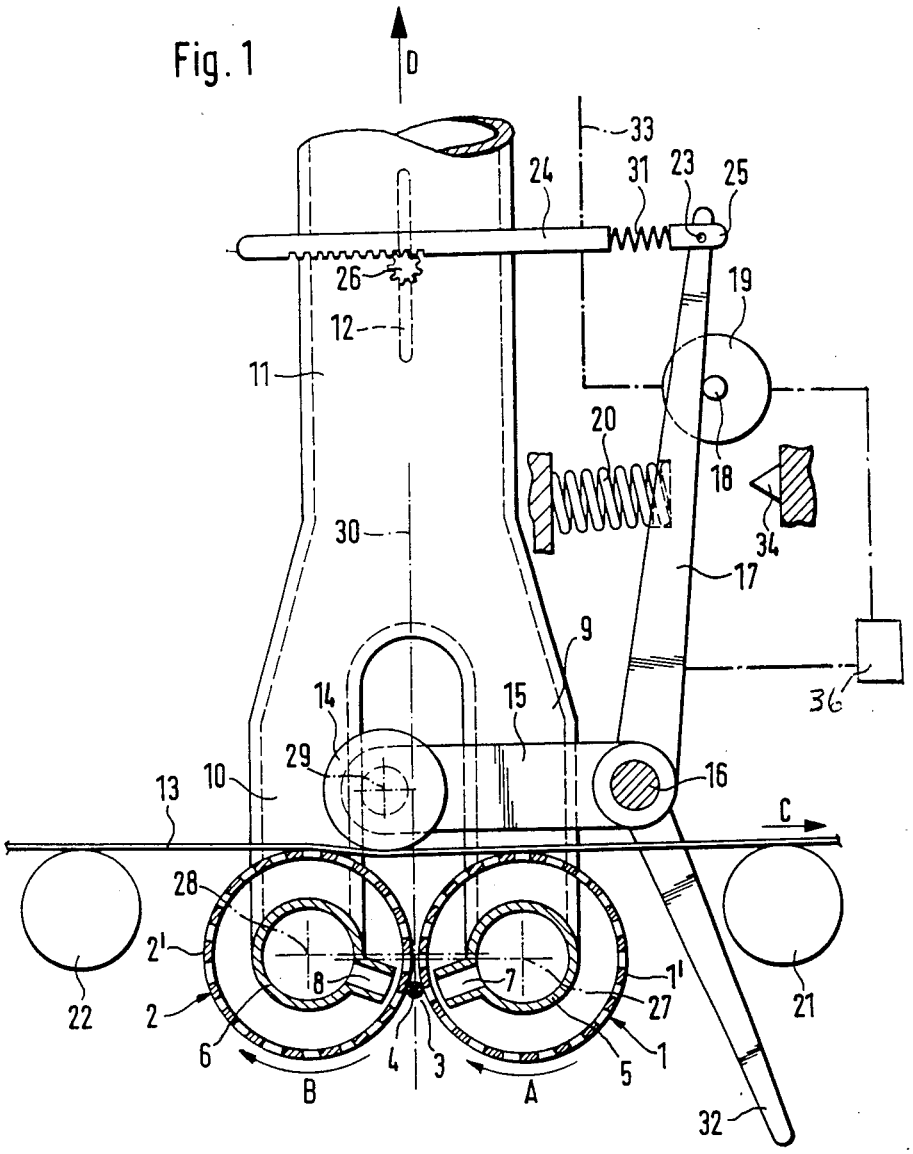
FIG. 1 is a partial cross-sectional view through an open-end friction spinning unit during operation.

The drawing shows only a part of an open-end friction spinning unit. In practice, a plurality of these open-end friction spinning units that are developed identically and are arranged in a row next to one another form an open-end friction spinning machine. In the case of the shown embodiment, the devices for the feeding and opening-up of fiber material and for the withdrawing and winding-up of the spun yarn into a spool are not shown. They may have a structure that is known per se and may, for example, be developed in a way that is known from DE-OS No. 33 21 234. The spinning unit contains two rollers (1) and (2) that are arranged in parallel and closely to one another and that form a wedge-shaped gap (3) serving as a yarn-forming zone. Fiber material that is opened up into individual fibers is fed to this yarn-forming zone in a known way and is twisted together into a yarn (4) that is withdrawn in longitudinal direction of the wedge-shaped gap (3) by means that are not shown and is wound onto a spool.

In the interior of the rollers (1) and (2), tubes (5) and (6) are arranged on which the shells (1', 2') of the rollers (1) and (2) may be disposed with roller bearings that are not shown. The shells (1', 2') are provided with a perforation. The tubes (5) and (6) are each equipped with a suction slot (7) and (8) that is aimed at the wedge-shaped gap (3). Via the suction slots (7) and (8), an air current is sucked in through the perforated shells (1') and (2') of the rollers (1) and (2) that is used for feeding fibers to the wedge-shaped gap (3), and for holding the forming yarn (4) in the wedge-shaped gap (3).

The tubes (5) and (6) are led out of the front sides of the pertaining rollers (1) and (2) and (10) are connected to a joint vacuum tube (11) via elbows (9). The vacuum tube (11) is connected with a vacuum source that produces an air flow in the direction of the Arrow (D), in a way that is not shown in detail. In the vacuum tube (11), a flap (12) or a slide are arranged via which the sucked-in air flow can be metered. In FIG. 1, the flap (2) is shown in a completely open position, and in FIG. 2 in a closed position.

The rollers (1) and (2) are driven by a tangential belt (13) that moves directly against the shell surfaces (1') and (2') of the rollers (1) and (2). The tangential belt (13) passes through in longitudinal direction of a machine in the direction of the Arrow (C) and drives all rollers (1) and (2) of all spinning units of one side of the machine. Via the tangential belt (13), the rollers (1) and (2) are driven in the same rotational direction (B) in the direction of the Arrows (A) so that the roller (1) rotates into the wedge-shaped gap (3) serving as the yarn-forming zone and the roller (2) rotates out of this edge-shaped gap (3) serving as the yarn-forming zone.

Laterally of the rollers (1) and (2), guide pulleys (21 and 22) for the tangential belt (13) are arranged between two spinning units. The guide pulleys form the moving plane for the tangential belt (13) that moves in longitudinal direction of the machine and moves closely past the shells (1') and (2') of the rollers (1) and (2). A freely rotatable tension roller (14) presses the tangential belt (13) out of this moving plane, determined by the guide rollers (21) and 22), and against the shell surface (1') and (2') of the rollers (1) and (2).

Figure 2:
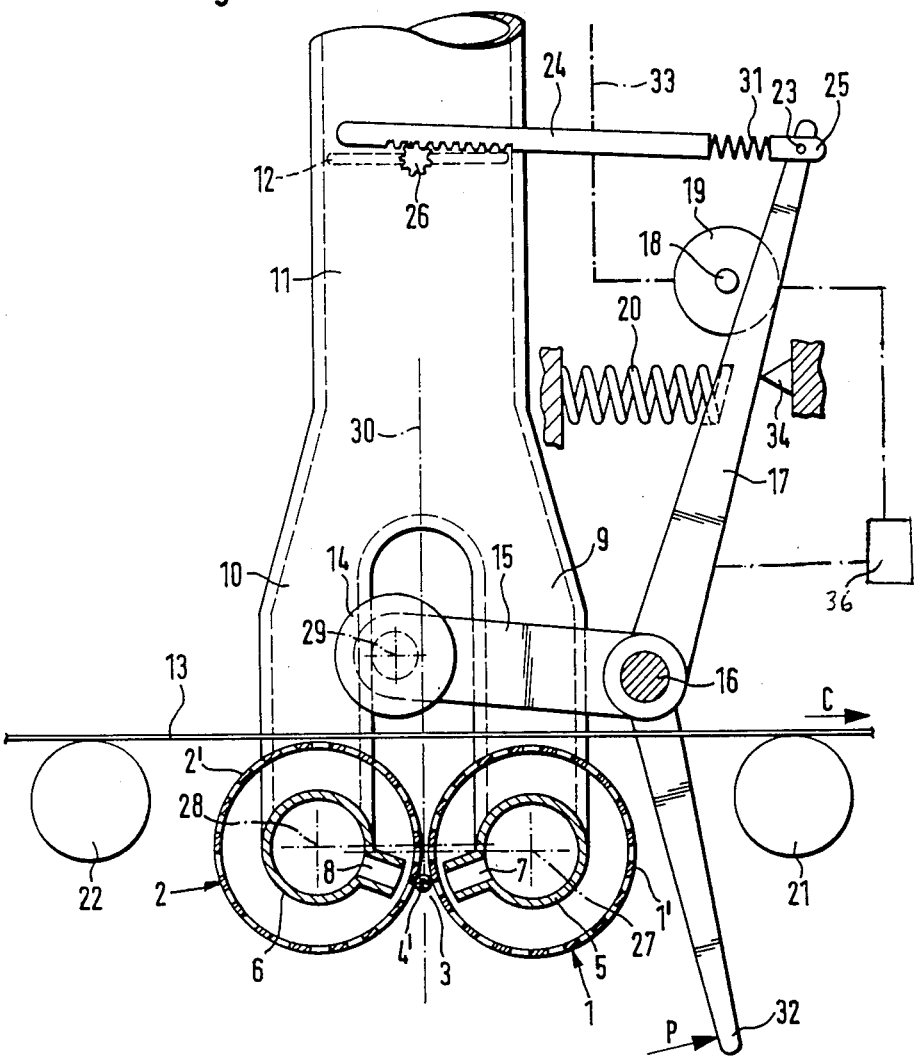
FIG. 2 is a partial cross-sectional view of the spinning unit according to FIG. 1 while the drive is interrupted.

The tension roller (14) is disposed on a swivel arm (15) that can be swivelled around a shaft (16) that extends in parallel to the shafts (27) and (28) of the rollers (1) and (2). The shaft (16) is mounted at the spinning unit in a stationary way. By swivelling the swivel arm (15), the tension roller (14) can be moved away from the rollers (1) and (2) so that the tangential belt (13) lifts off the shell surfaces (1') and (2') of the rollers (1) and (2) (FIG. 2). For the stopping of the rollers(1) and (2), if necessary, additional braking elements may also be provided that are not shown and that, for the lifting-off of the tension roller (14) and of the tangential belt (13) are applied to the shells (1') and (2') of the rollers (1) and (2).

The swivel arm (15) is connected with the arm (17) via the shaft (16), in a torsionally fixed way. The arm (17) is held in the operating position against the effect of a spring (20) by a preferably adjustable stop (18). The stop (18) is controlled by a solenoid (19) that is connected with a yarn guard that is not shown via a line (33). In the case of a yarn breakage, the stop (18), via the solenoid (19), is moved out of the swivel range of the arm (17), so that this arm is pressed against a stationary stop (34) by the spring (20). The tension roller (14) is thereby moved away from the rollers (1) and (2) so that the tangential belt (13) is lifted off the rollers.

A two-part rod (24, 25) is coupled to the arm (17) via a joint (23). The parts of the rod (24, 25) are connected with one another by a spring (31). The part (24) is manufactured as a toothed rack that engages in a pinion (26) that is connected with the flap (12) in a torsionally fixed way. When the stop (18) is moved out of the swivel range of the lever (17), in the case of a yarn breakage, the rod (24, 25) is also moved by the arm (17), so that the flap (12) is closed (FIG. 2). During the closing, the flap (12) or the rod (24) move against a stop. The part (25) that is also moved will then pull the spring (31) apart.

An actuating arm (32) that projects out of the spinning unit in the direction of the operating side is connected with the swivel arm (15) in a torsionally fixed way via the shaft (16). The actuating arm (32) is swivelled in the direction of the Arrow (P) (FIG. 2) by an operator or by an automatic servicing arrangement for the restarting of the spinning unit. Thus, the swivel arm (15) and the arm (17) are swivelled counterclockwise, and the stop (18) is moved into the swivel range of the arm (17) via the solenoid (19) such that the stop (18) engages in the path of movement of the arm (17) again and holds it in the operating position (FIG. 1). In a preferred embodiment, the solenoid (19) and arms (15, 17) are connected to a control mechanism (36) which assures proper cooperation between these elements during the piecing process. At the same time, the spring (31) is unloaded, and subsequently this spring acts as a pressure spring and shifts the part (24) of the rod in such a way that the flap (12) is reopened.

During the restarting of the drive of the rollers (1) and, (2) in connection with a piecing process in which a yarn end (4') to be pieced (FIG. 2) is inserted into the yarn-forming zone of the wedge-shaped gap (3), there is the danger that the yarn end (4'), may be pulled too deeply into the wedge-shaped gap (3) and is therefore immediately twisted off during the starting of the rollers (1) and (2). In order to avoid this danger, it is provided that during the restarting of the drive of the rollers (1) and (2), the roller (2) that rotates out of the wedge-shaped gap (3) starts by a fraction of a second earlier than the roller (1) rotating into the wedge-shaped gap (3). As a result, the yarn end (4') to be pieced is moved slightly out of the wedge-shaped gap (3), at least with respect to its tendency to move into the gap, at least until a certain balanced condition is achieved between the frictional effects of the rollers (1) and (2) with respect to the yarn end (4').

In the shown embodiment, the roller (2) rotating out of the yarn-forming zone of the wedge-shaped gap (3) is arranged with its shaft (28) slightly closer to the moving plane of the tangential belt (13) determined by the guide pulleys (21) than the shaft (27) of the roller (1) rotating into the wedge-shaped gap (3). When the tangential belt (13) is moved back from the inoperative position (FIG. 2) by the tension roller (14) into the operative position (FIG. 1), the tangential belt comes to rest a little earlier at the shell (2') of the roller (2) than at the shell (1') of the roller (1). By this arrangement, it is ensured that the roller (2) starts a little earlier than the roller (1). In addition, it is also provided in the shown embodiment that the shaft (29) of the tension roller (14), extending in parallel to the shafts (27) and (28) of the rollers (1) and (2), is located closer to the shaft (28) of the roller (2) rotating out of the wedge-shaped gap (3), so that the pressure of the tangential belt (13) on the shell (2') of the roller (2) is increased as compared to the pressure against the shell (1') of the roller (1).

In addition, it is provided that via the actuating lever (32), the flap (12) opens in a delayed way because of the arrangement of the rod (24) and (25) and the spring (31), so that the rollers (1) and (2) start before the suction air flow is generated again in the yarn-forming zone of the wedge-shaped gap (3). This measure alone, under certain circumstances, may be sufficient to prevent the yarn end (4') to be pieced from entering too far into the wedge-shaped gap (3).

If braking elements are provided for braking the rollers (1) and (2) in the case of a yarn breakage, these elements may be utilized for preventing the yarn end (4') from being pulled too far into the wedge-shaped gap.

This would be achieved by keeping the roller (1) rotating into the wedge-shaped gap in a braked condition a little longer than the roller (2) rotating out of the wedge-shaped gap. Therefore, the roller (2) would commence rotating out of the yarn-forming zone before the roller (1).

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Piecing process for an open-end friction spinning apparatus of the type including:

movable friction surface means for forming yarn including a pair of friction rollers operating as said friction surface means forming a yarn-forming zone therebetween;

friction surface driving means for moving said friction surface means during operation and for interrupting the movement of said friction surface means, said friction surface driving means including roller driving means for driving one roller into the yarn-forming zone and for driving another roller out of the yarn-forming zone;

yarn end orientation means for orienting a yarn end during the piecing process;

said process comprising:

placing a yarn end into the yarn-forming zone when the friction surface means are stopped; and starting the friction surface means whereby said yarn end is prevented from being pulled too deeply into said yarn-forming zone by the yarn end orientation means, said starting of the friction surface means including using control means for preventing the roller rotating into the yarn-forming zone from starting prior to the starting of the roller rotating out of the yarn-forming zone.

2. Piecing process as in claim 1, wherein the starting of the friction surface means includes starting the roller rotating out of the yarn-forming zone at least at the same time as the roller rotating into the yarn-forming zone.

3. Piecing process as in claim 1, wherein open-end friction spinning apparatus further includes:

holding force means for applying suction forces to hold the forming yarn in the yarn-forming zone, said holding force means including a switch means for switching the holding means between operative and inoperative modes;

wherein the starting of the friction surface means includes moving said friction surface means before switching said holding force means into the operative mode.

4. Piecing process as in claim 2, wherein the open-end friction spinning apparatus further includes:

holding force means for applying suction forces to hold the forming yarn in the yarn-forming zone, said holding force means including a switch means for switching the holding means between operative and inoperative modes;

wherein the starting of the friction surface means further includes moving the friction rollers before switching said holding force means into the operative mode.

5. Apparatus for open-end friction spinning comprising:

movable friction surface means for forming yarn including a pair of friction rollers operating as said friction surface means forming a yarn-forming zone therebetween;

friction surface driving means for moving said friction surface means during operation and for interrupting the movement of said friction surface means, said friction surface driving means including roller driving means for driving one roller into the yarn-forming zone and for driving another roller out of the yarn-forming zone; and yarn end orientation means for preventing a yarn end from being pulled too deeply into said yarn-forming zone during a piecing process including control means for preventing the roller rotating into the yarn-forming zone from starting prior to the starting of the roller rotating out of the yarn-forming zone.

6. Apparatus as in claim 5, wherein said yarn end orientation means assures that the roller rotating out of the yarn forming zone is started at least at the same time as the roller rotating into the yarn-forming zone.

7. Apparatus as in claim 6, wherein said driving means includes a driving belt means, said driving belt means being movable between an operable position contacting said rollers and an interrupted position away from said rollers, wherein said driving belt means contacts the roller rotating out of the yarn-forming zone before contacting the roller rotating into the yarn-forming zone when moved from said interrupted position toward said operable position.

8. Apparatus as in claim 7, further including guiding means for guiding the driving belt means, said guiding means guiding the driving belt means such that when the driving belt means is placed back against the rollers, the driving belt means will first contact the roller rotating out of the yarn-forming zone.

9. Apparatus as in claim 6, further including holding force means for applying suction forces to hold the forming yarn in the yarn-forming zone, said holding force means including switching means for switching the holding force means between operative and inoperative modes, said switching means switching the holding means in the operative mode after said roller driving means starts driving the rollers.

10. Apparatus as in claim 9, wherein said roller driving means includes a driving belt means, said driving belt means being movable between an operable position contacting said rollers and an interrupted position away from said rollers, wherein said driving belt means contacts the roller rotating out of the yarn-forming zone before contacting the roller rotating into the yarn-forming zone when moved from said interrupted position toward said operable position.

11. Apparatus as in claim 10, further including driving belt moving means for moving the driving belt means between the operable position and the interrupted position.

12. Apparatus as in claim 11, wherein said driving belt moving means and said switching means are coupled such that the switching of the holding means to the operative mode is delayed with respect to moving the driving belt means to the operable position.

13. Apparatus as in claim 12, further including a lever element connected to both the driving belt moving means and the switching means.

14. Apparatus as in claim 13, further including a stop element having an activated position for holding the lever in the operable position and an inactivated position allowing said lever to move to an inoperable position, and a solenoid coupled to said stop element, said solenoid controlling the position of said stop element.

15. Apparatus as in claim 14, further including a control element for controlling the cooperation of the lever element and the solenoid.

16. Piecing process as in claim 1, wherein the starting of the friction surface means includes starting the roller rotating out of the yarn-forming zone before starting the roller rotating into the yarn-forming zone.

17. Apparatus as in claim 5, wherein said yarn end orientation means assures that the roller rotating out of the yarn forming zone is started before the roller rotating into the yarn-forming zone.

18. Apparatus for open-end friction spinning comprising:

movable friction surface means for forming yarn including a pair of friction rollers operating as said friction surface means forming a yarn-forming zone therebetween;

friction surface driving means for moving said friction surface means during operation and for interrupting the movement of said friction surface means, said friction surface driving means including roller driving means for driving one roller into the yarn-forming zone and for driving another roller out of the yarn-forming zone, said driving means including a driving belt means, said driving belt means being movable between an operable position contacting said rollers and an interrupted position away from said rollers, said driving belt means contacting the roller rotating out of the yarn-forming zone before contacting the roller rotating into the yarn-forming when moved from said interrupted position toward said operable position; and yarn end orientation means for preventing a yarn end from being pulled too deeply into said yarn-forming zone during a piecing process, said yarn end orientation means assuring that the roller rotating out of the yarn-forming zone is started at least at the same time as the roller rotating into the yard-forming zone.

19. Apparatus as in claim 18, further including guiding means for guiding the driving belt means, said guiding means guiding the driving belt means such that when the driving belt means is placed back against the rollers, the driving belt means will first contact the roller rotating out of the yarn-forming zone.

20. Apparatus as in claim 18, further including holding force means for applying suction forces to hold the forming yarn in the yarn-forming zone, said holding force means including switching means for switching the holding force means between operative and inoperative modes, said switching means switching the holding means in the operative mode after said roller driving means starts driving the rollers.

21. Apparatus as in claim 20, further including driving belt moving means for moving the driving belt means between the operable position and the interrupted position.

22. Apparatus as in claim 21, wherein said driving belt moving means and said switching means are coupled such that the switching of the holding means to the operative mode is delayed with respect to moving the driving belt means to the operable position.

23. Apparatus as in claim 22, further including a lever element connected to both the driving belt moving means and the switching means.

24. Apparatus as in claim 23, further including a stop element having an activated position for holding the lever in the operable position and an inactivated position allowing said lever to move to an inoperable position, and a solenoid coupled to said stop element, said solenoid oontrolling the position of said stop element.

25. Apparatus as in claim 24, further including a control element for controlling the cooperation of the lever element and the solenoid.

* * * * *